US009879355B2

(12) United States Patent
Bares et al.

(10) Patent No.: US 9,879,355 B2
(45) Date of Patent: Jan. 30, 2018

(54) METHOD FOR ANODIZING PARTS MADE OF AN ALUMINUM ALLOY

(71) Applicant: MECAPROTEC INDUSTRIES, Muret (FR)

(72) Inventors: Pierre Bares, Mondavezan (FR); Celine Gazeau, Rodez (FR); Cedric Stephan, Saint Renan (FR); David Pedelmas, Limoux (FR); Claude Rossignol, Bressols (FR); Sylvain Bruet, Brens (FR); Olivier Brucelle, Villeneuve (FR); Paul Dedieu, Villeneuve Tolosane (FR); Philippe Combes, Toulouse (FR); Laurent Arurault, Castanet-Tolosan (FR); Viviane Turq, Toulouse (FR); Jean-Jacques Rousse, Azereix (FR); Kevin Klepman, Pau (FR)

(73) Assignee: MECAPROTEC INDUSTRIES, Muret (FR)

( * ) Notice: Subject to any disclaimer, the term of this patent is extended or adjusted under 35 U.S.C. 154(b) by 643 days.

(21) Appl. No.: 14/377,503

(22) PCT Filed: Feb. 11, 2013

(86) PCT No.: PCT/EP2013/052686

§ 371 (c)(1),
(2) Date: Aug. 7, 2014

(87) PCT Pub. No.: WO2013/117759

PCT Pub. Date: Aug. 15, 2013

(65) Prior Publication Data

US 2016/0047057 A1 Feb. 18, 2016

(30) Foreign Application Priority Data

Feb. 10, 2012 (FR) ..... 12 51273

(51) Int. Cl.

| | |
|---|---|
| ***C25D 11/08*** | (2006.01) |
| ***C25D 11/02*** | (2006.01) |
| ***C25D 11/16*** | (2006.01) |
| ***C25D 11/24*** | (2006.01) |
| ***C25D 11/38*** | (2006.01) |

(52) U.S. Cl.
CPC ..... *C25D 11/024* (2013.01); *C25D 11/08* (2013.01); *C25D 11/16* (2013.01); *C25D 11/246* (2013.01); *C25D 11/38* (2013.01)

(58) Field of Classification Search
CPC ..... C25D 11/024; C25D 11/246
See application file for complete search history.

(56) References Cited

U.S. PATENT DOCUMENTS

| | | | | |
|---|---|---|---|---|
| 6,797,014 | B1 * | 9/2004 | Schofberger | C25D 11/243 8/522 |
| 2002/0117236 | A1 * | 8/2002 | Matzdorf | C09D 5/084 148/247 |
| 2003/0196907 | A1 * | 10/2003 | Viola | C25D 11/08 205/324 |
| 2004/0050709 | A1 * | 3/2004 | Cadwell Stancin | C25D 11/08 205/213 |
| 2005/0150771 | A1 * | 7/2005 | Kock | C25D 11/04 205/172 |
| 2006/0213589 | A1 * | 9/2006 | Sawada | B22D 11/0622 148/549 |

FOREIGN PATENT DOCUMENTS

| | | |
|---|---|---|
| DE | 4213535 C1 | 9/1993 |
| EP | 0232211 A1 | 8/1987 |
| FR | 1452852 A | 4/1966 |

OTHER PUBLICATIONS

Tharp et al., "Chromic and Sulfuric Acid Anodizing of Aluminum Alloys for Military Applications," Plating Journal of the American Electroplaters' Society, Jun. 1968, pp. 580-83, vol. 55, No. 6.
Beck, "Performance Validation of Thin-Film Sulfuric Acid Anodization (TFSAA) on Aluminum Alloys," Jun. 10, 2014.
Augros et al., "Innovative Cr-free anodizing & sealing processes for corrosion protection of aerospace aluminum alloys," Surfair 2006.
SAE Aerospace, "Anodic Treatment of Aluminum Alloys Sulfuric Acid Process, Undyed Coating," Aerospace material Specification, Dec. 2008, pp. 1-7, downloaded from SAE International by null AFNOR on Sep. 12, 2016.
AESF/EPA Conference for Environmental & Process Excellence, Metal Finishing, Feb. 3-6, 2003, pp. 28-40, Adams Mark Resort, Daytona Beach, FL, US.
Sheasby et al., "The Surface Treatment and Finishing of Aluminium and its Alloys," 2001, pp. 1102-1111, Sixth Edition, vol. 2, ASM International, Ohio, USA.
Majid Shahzad, "Influence of roughness and anodizing treatments on the fatigue behavior of aeronautical aluminum alloys 2214 and 7050," PhD Thesis, Université de Toulouse, Mar. 18, 2011, https://depozi.isae.fr/theses/2011/2011_Shahzad_Majid.pdf. (Translation of Relevant Portion of Document Is Provided).

* cited by examiner

*Primary Examiner* — Bryan D. Ripa
(74) *Attorney, Agent, or Firm* — Im IP Law; C. Andrew Im

(57) ABSTRACT

A method for anodizing a part made of aluminum or an aluminum alloy by immersing the part in an aqueous bath essentially comprising sulfuric acid at a concentration of 150 to 250 g/L and at a temperature of 5 to 25° C. A DC voltage according to a voltage profile comprising a voltage increased at a rate of 1 to 32 V/min is applied to the part. The voltage is maintained at a plateau voltage value of 12 to 20 V for a duration sufficient for obtaining, at the surface of the part, an anode layer having a thickness of 3 to 7 μm and/or a layer weight of 20 to 150 mg/dm$^2$.

18 Claims, 1 Drawing Sheet

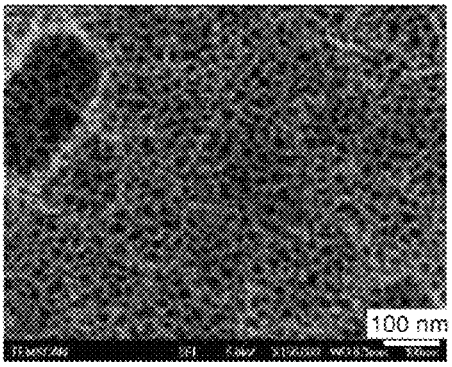
FIG. 1A
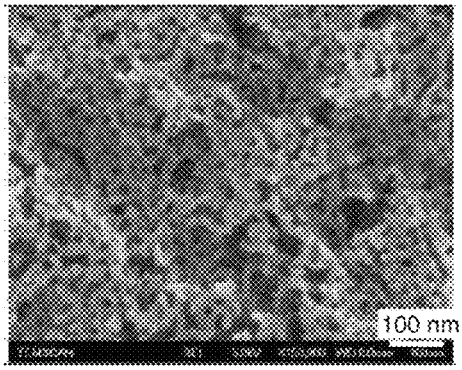
FIG. 1B
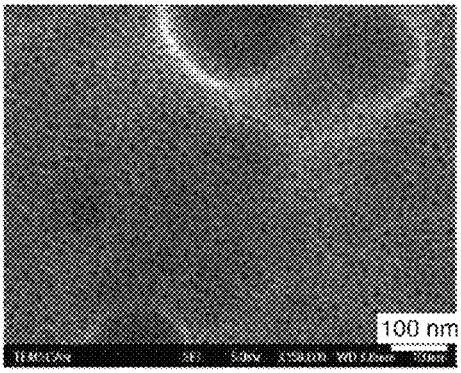
FIG. 1C
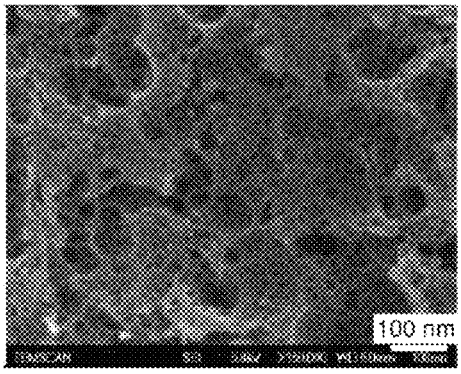
FIG. 1D
FIG. 1E
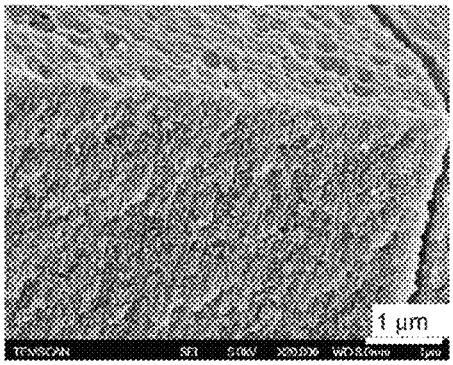

METHOD FOR ANODIZING PARTS MADE OF AN ALUMINUM ALLOY

RELATED APPLICATIONS

This application is a § 371 application from PCT/EP2013/052686 filed Feb. 11, 2013, which claims priority from French Patent Application No. 12 51273 filed Feb. 10, 2012, each of which is herein incorporated by reference in its entirety.

TECHNICAL FIELD OF THE INVENTION

The present invention relates to the field of surface treatment of parts in aluminum or aluminum alloy, with the aim of improving their corrosion resistance properties. More particularly, it relates to a method for anodizing a part made of aluminum or an aluminum alloy, as well as to a more general method of surface treatment of such a part using said anodizing method followed by a sealing step.

BACKGROUND OF THE INVENTION

Aluminum alloy parts intended to be used in the aeronautical sector, or in other sectors in which they are likely to be exposed to corrosion risks that may prove problematic, generally receive, prior to application, a surface treatment with the aim of protecting them against corrosion.

One of the techniques most widely used for this purpose is anodizing, also called anodic oxidation, which consists of forming, on the surface of the part, a porous layer of aluminum oxides/hydroxides, called an anodic layer, by applying a current to the part immersed in an electrolytic bath containing an electrolyte of the strong acid type, the part constituting the anode of the electrolytic device. The anodic layer thus formed on the surface of the part, after undergoing a sealing post-treatment, protects the part against corrosion. This anodic layer also constitutes a substrate suitable for conventional paint systems.

The electrolytic baths employed at present for anodizing aluminum alloy parts, which provide the most advantageous performance notably in terms of protecting the part against corrosion, mechanical bonding of paint coatings to the surface of the part, and reduction in fatigue strength, are formed on the basis of hexavalent chromium. However, chemicals containing hexavalent chromium have proved to be harmful to health and to the environment.

In order to avoid the use of substances based on hexavalent chromium for anodizing aluminum alloy parts, anodizing processes have been proposed in the prior art using other strong acids in the electrolytic bath, and in particular sulfuric acid. However, none of these baths gives satisfactory performance in terms simultaneously of protection of the part against corrosion, adherence of conventional paint systems on the part, and reduction in fatigue strength of the part. The performance proves insufficient notably in respect of the requirements imposed in the aeronautical sector.

OBJECT AND SUMMARY OF THE INVENTION

The present invention aims to overcome the drawbacks of the methods for anodizing aluminum alloy parts of the prior art, notably those presented above, by proposing such a method that does not use any harmful substance, notably based on hexavalent chromium, while displaying performance at least equivalent to the methods of the prior art using hexavalent chromium, in particular in terms of corrosion resistance of the treated part, reduction in fatigue strength of the part and adherence of conventional paint systems on its surface.

It has now been discovered by the present inventors that an anodizing method of the sulfuric acid type, carried out in particular conditions, made it possible to achieve these objectives.

Thus, an anodizing method is proposed according to the present invention for anodizing an aluminum or aluminum-alloy part, according to which the part is immersed in an aqueous bath essentially comprising sulfuric acid at a concentration between 150 and 250 g/L and maintained at a constant temperature between 5 and 25° C. "Essentially comprising sulfuric acid" means that the bath does not contain any other electrolytically active substance, notably strong acid, in sufficient amount for it to be involved in the anodizing process. The bath notably does not contain phosphoric, boric, chromic or tartaric acid, or does, but only in trace amounts.

This method according to the invention is characterized by the application, to the part immersed in the bath, of a DC voltage according to a voltage profile comprising an increase in voltage, from a starting value of 0 V, at a rate between 1 and 32 V/min, then maintaining the voltage at a so-called plateau voltage value between 12 and 20 V for a sufficient time to obtain an anodic layer, of aluminum oxides/hydroxides, with a thickness between 3 and 7 μm, preferably between 3 and 5 μm, and/or a layer weight between 20 and 150 mg/dm$^2$, on the surface of the part.

This anodic layer displays properties of adherence to paint and of corrosion resistance after sealing equivalent to those of the anodic layers obtained by the chromic acid anodizing processes of the prior art, and without employing a substance based on hexavalent chromium.

This result is moreover advantageously obtained with a small thickness of the anodic layer, i.e. less than or equal to 7 μm, preferably less than or equal to 5 μm, whereas the so-called standard sulfuric anodizing processes proposed in the prior art require, to attain acceptable performance, which nevertheless remains below that of the method according to the invention, forming an anodic layer of much greater thickness, typically between 8 and 12 μm, on the part. The method according to the invention therefore offers an additional advantage, which is that it does away with problems of redimensioning and reduction in fatigue strength caused by the standard sulfuric anodizing processes of the prior art.

In particular embodiments of the invention, the voltage profile applied to the part comprises an increase in voltage at a rate between 1 and 32 V/min until the so-called plateau voltage value is reached between 12 and 20 V, then maintaining the voltage at said plateau voltage value for a sufficient time to obtain an anodic layer, of aluminum oxides/hydroxides, of thickness between 3 and 7 μm, preferably between 3 and 5 μm, and/or of layer weight between 20 and 150 mg/dm$^2$, on the surface of the part.

In different embodiments, the voltage profile applied to the part comprises a plurality of phases of voltage increase, at least one of which is carried out at a rate between 1 and 32 V/min, and which may be separated two by two by a plateau during which the voltage is maintained temporarily at a fixed value, before application of the final phase of maintaining the voltage at the plateau voltage value between 12 and 20 V.

A person skilled in the art is able to determine the time for maintaining the voltage at the plateau value, to obtain the desired thickness of anodic layer on the part, notably as a function of the characteristics of the particular alloy and the conditions of subsequent use of the part.

In some embodiments of the invention, the voltage is maintained at the plateau value for a time between 5 and 30 minutes, according to the aluminum alloy and the desired thickness of the anodic layer.

According to an advantageous feature of the invention, in terms of performance of protection of the part against corrosion, the rate of increase in voltage is between 1 and 6 V/min, preferably equal to 3 V/min.

Preferably, the plateau voltage value is between 14 and 16 V. A person skilled in the art is able to determine the optimal voltage value within this range, notably in relation to the characteristics of the alloy of which the part is constituted.

The concentration of sulfuric acid in the bath is preferably between 180 and 220 g/L, for example equal to 200 g/L.

In some embodiments of the invention, the bath temperature is between 15 and 25° C., preferably between 18 and 20° C., and for example equal to 19° C.

All these preferred parameters ensure the best performance of the bath from the standpoint of the properties of the anodic layer formed on the surface of the part.

The part may be submitted to a step of surface preparation by degreasing and/or pickling prior to its immersion in the bath, so as to remove grease, dirt and oxides present on its surface.

This preliminary step of surface preparation may comprise one or more of the following operations:

- solvent degreasing, to dissolve any grease present on the surface of the part. This operation may be carried out by dipping, spraying, or any other technique known per se. It may for example be carried out by dipping in Methoklone or acetone, at a temperature below 42° C., for a time between 5 seconds and 3 minutes;
- alkaline degreasing, to dissolve any grease present on the surface of the part. This operation may be carried out by dipping, spraying, or any other technique known per se. It may for example be carried out by dipping in a mixture of TURCO 4215 NCLT (Henkel), at 40 to 60 g/L, and of TURCO 4215 additive (Henkel), at 5 to 20 g/L, at a temperature between 50 and 70° C., for a time between 10 and 30 minutes;
- alkaline pickling, to dissolve the oxides formed naturally on the surface of the part. This operation may be carried out by dipping, spraying, or any other technique known per se. It may for example be carried out by dipping in a solution of sodium hydroxide at 30 to 70 g/L, at a temperature between 20 and 60° C., for a time between 10 seconds and 2 minutes. At the end of this operation, the part is covered with a pulverulent layer formed of oxidation products of the intermetallic compounds, which should be removed in a step of acid pickling;
- acid pickling, to dissolve the oxides formed naturally on the surface of the part, and/or the oxidized layer formed on the surface of the part during the alkaline pickling step. This operation may be carried out by dipping, spraying, or any other technique known per se. It may for example be carried out by dipping in a solution of SMUT-GO NC (Henkel) at 15 to 25% v/v, at a temperature between 10 and 50° C., for a time between 1 and 10 minutes; or by dipping in a solution of ARDROX 295GD (Chemetall) at 15 to 30% v/v, at a temperature between 10 and 30° C., for a time between 1 and 10 minutes.

Interposed rinsings, notably with water, are preferably carried out between the aforementioned successive steps, and prior to treatment of the part by anodizing.

Another aspect of the invention is a more general method of surface treatment of a part in aluminum or aluminum alloy, according to which the part is submitted to an anodizing method corresponding to one or more of the features mentioned above, then to a step of sealing the anodic layer thus formed on the part.

The step of sealing the porous anodic layer may be of any type known by a person skilled in the art. It may for example be hydrothermal sealing, hot sealing with hexavalent chromium salts or with nickel salts, etc. The methods of sealing that do not employ any substance that is harmful to the environment and/or health are particularly preferred in the context of the invention.

In advantageous embodiments of the invention, this sealing step comprises immersion of the part in an aqueous bath containing a trivalent chromium salt and an oxidizing compound, with a temperature between 20 and 80° C., preferably between 20 and 60° C., more particularly between 35 and 45° C., and/or immersion of the part in water at a temperature between 98 and 100° C., and with pH for example between 4.5 and 8.

In the present description, trivalent chromium means, conventionally per se, chromium in the +3 oxidation state. Hexavalent chromium means chromium in the +6 oxidation state.

The oxidizing compound may be of any type known per se for baths for post-anodizing sealing of aluminum or aluminum alloys. Compounds that do not have a harmful effect on the environment are particularly preferred in the context of the invention. Nonlimiting examples of these oxidizing compounds are substances based on fluorides, such as ammonium fluoride or potassium fluozirconate $K_2ZrF_6$, on permanganate, such as potassium permanganate, on hydrogen peroxide $H_2O_2$, etc. The concentration of oxidizing compound in the bath may notably be between 0.1 and 50 g/L.

The trivalent chromium salt and the oxidizing compound present in the bath may consist of two different compounds, or of one and the same compound that is able just by itself to provide the two functions of inhibition of corrosion and of oxidation, for example trivalent chromium fluoride $CrF_3$.

The trivalent chromium salt may be supplied in any conventional form per se for treatments of post-anodizing sealing of aluminum, notably in the form of fluoride, chloride, nitrate, acetate, acetate hydroxide, sulfate, potassium sulfate, etc., of trivalent chromium, for example $CrF_3,xH_2O$, $CrCl_3,xH_2O$, $Cr(NO_3)_3,xH_2O$, $(CH_3CO_2)_2Cr,xH_2O$, $(CH_3CO_2)_7Cr_3(OH)_2,xH_2O$, $Cr_2(SO_4)_3,xH_2O$, $CrK(SO_4)_2,xH_2O$, etc.

In preferred embodiments of the invention, the trivalent chromium salt present in the bath is a fluoride. It is for example chromium trifluoride $CrF_3$.

In particular embodiments of the invention, the step of immersing in the aqueous bath corresponds to one or more of the following operating parameters:

- the bath temperature is between 20 and 80° C., preferably between 20 and 60° C., more preferably between 35 and 60° C., and preferably between 35 and 45° C., for example equal to 40° C.;
- the bath pH is between 3 and 4.5, preferably between 3 and 4, for example equal to 3.5;

the duration of immersion in the bath is between 5 and 40 min, preferably between 10 and 30 minutes, for example equal to 15 or 20 minutes.

The concentration of trivalent chromium salt in the bath is preferably between 0.5 and 50 g/L.

The immersion of the part in water at a temperature between 98 and 100° C. may be carried out with a duration of immersion between 10 and 60 minutes, according to the operating parameters of the so-called conventional hydrothermal methods of sealing.

In particular embodiments of the invention, the sealing step comprises immersing the part successively in the aqueous bath containing a trivalent chromium salt and an oxidizing compound, and in water at a temperature between 98 and 100° C. These steps may be carried out in any order, and notably may be separated by one or more interposed rinsings with water.

For example, the sealing step may comprise immersing the part in the aqueous bath containing a trivalent chromium salt and an oxidizing compound, then, after optional rinsing(s), in water at a temperature from 98 to 100° C. Otherwise, the sealing step may comprise immersing the part in water at a temperature from 98 to 100° C., then, after optional rinsing(s), in the aqueous bath containing a trivalent chromium salt and an oxidizing compound.

BRIEF DESCRIPTION OF THE DRAWINGS

The features and advantages of the invention will become clearer from the embodiment examples given below, supplied purely for purposes of illustration and not in any way limiting the invention, with the aid of FIGS. 1A to 1E, which show micrographs of anodic layers formed on the surface of aluminum parts by, FIG. 1A, chromic anodizing (OAC), FIG. 1B, standard sulfuric anodizing (OASstandard), FIG. 1C, sulfo-tartaric anodizing (OAST), FIG. 1D, sulfo-boric anodizing (OASB) and FIG. 1E, anodizing according to an embodiment of the invention.

DETAILED DESCRIPTION OF THE EMBODIMENTS

Example 1

1.1. Methods of Anodizing Aluminum Alloy Parts

Parts in rolled aluminum alloy 2024 T3 with the dimensions 120×80×2 mm are treated by anodizing by the following methods.

Steps of surface preparation of the part are first carried out successively:

- alkaline degreasing, by dipping the part in a mixture of TURCO 4215 NCLT at 50 g/L and TURCO 4215 additive at 10 g/L, at a temperature of 60° C., for 20 min;
- water rinsings;
- acid pickling, by dipping the part in a solution of SMUT-GO NC at 19% v/v, at a temperature of 20° C., for 5 min;
- water rinsings.

Some parts are then submitted to an anodizing process according to an embodiment of the invention, as follows.

A bath is prepared by diluting a sulfuric acid solution in water to obtain a concentration of sulfuric acid of 200 g/L, excluding any other compound. This bath is adjusted to and maintained at a temperature of 19° C.

The part is immersed in the bath, and a DC voltage is applied to it according to the following voltage profile: voltage increase, from an initial value of 0 V, at a rate of 3 V/min, up to a so-called plateau value of 16 V. The voltage is maintained at the plateau value for 16 minutes.

An anodic layer of aluminum oxide/hydroxide with a thickness of about 4 to 5 μm forms on the surface of the part.

As comparative examples, identical parts that have undergone the same operations of surface preparation are anodized according to the conventional methods of chromic anodizing (OAC), standard sulfuric anodizing (OAS standard), sulfo-tartaric anodizing (OAST) and sulfo-boric anodizing (OASB).

The operating parameters for OAS standard, OAST, OASB and OAC are shown below in Table 1.

TABLE 1 operating parameters employed for the different anodizing processes of the prior art OAS standard, OAST, OASB and OAC

| | OAS standard | OAST | OASB | OAC |
|---|---|---|---|---|
| Bath composition | $H_2SO_4$: 200 g/L | $H_2SO_4$: 40 g/L $C_4H_6O_6$: 80 g/L | $H_2SO_4$: 45 g/L $H_3BO_3$: 8 g/L | $CrO_3$: 60 g/L $C_2H_2O_4$: 2 g/L |
| Bath temperature (° C.) | 16-20 | 36-39 | 25-28 | 38-42 |
| Voltage increase (V/min) | 3.4 | 2.8 | 5.3 | 4 |
| Plateau voltage and duration | 17 V 40 min | 14 V 25 min | 15 V 23 min | 20 V 50 min |
| Thickness of the anodic layer formed on the part (μm) | 8 to 10 | 2 to 5 | 1 to 3 | 3 to 5 |

The various parts thus obtained are submitted to the following tests.

1.2. Morphological Analysis of the Anodic Layer

A morphological analysis of the anodic layer formed on the surface of each of the parts thus treated is carried out by field-effect electron microscopy (FEG-SEM). The micrographs are shown in FIGS. 1A to 1E. FIG. 1E, corresponding to the anodic layer obtained by a method according to an embodiment of the invention, shows a morphology that is uniform through the thickness of the layer, with absence of micro-precipitates derived from the substrate within the layer. Based on the micrographic observations, the pore diameters were measured for each of the anodic layers and the results are shown in Table 2 below.

TABLE 2

Diameter of the pores in the anodic layer formed on the parts made of rolled aluminum alloy 2024 T3 as a function of the method of anodizing employed

| | Method of anodizing | | | Anodizing according to |
|---|---|---|---|---|
| | OAC | OAST | OASB | the invention |
| Diameter of the pores in the anodic layer (nm) | 20-30 | 5-10 | 5-10 | 10-20 |

It can be seen in this table that the morphology of the anodic layer formed on the parts by the method according to an embodiment of the invention is more similar to that of a layer obtained by chromic anodizing, relative to the other anodizing processes using sulfuric acid proposed in the prior art.

1.3. Tests of Reduction in Fatigue Strength

The various anodized parts are submitted to a fatigue test in order to evaluate the reduction in fatigue strength associated with formation of the anodic layer on their surface. The parameters of the fatigue test are as follows:

loading: rotating bending
temperature: 20° C.
R=−1
Frequency: 100 Hz
Kt=1.035
type of test specimens: FFRT16
number of test specimens: 12

The results of this test, in terms of fatigue limit and reduction relative to the unanodized parts, for parts treated by the method according to an embodiment of the invention and by different conventional methods, are shown in Table 3 below.

TABLE 3

Reduction in fatigue strength evaluated by a fatigue test for parts in aluminum alloy 2024 T3 as a function of the anodizing process employed

| | Untreated part | Part treated by OAC | Part treated by OAS standard | Part treated by anodizing according to the invention |
|---|---|---|---|---|
| Fatigue limit ($10^7$ cycles) 90% survival (MPa) | 147 | 120 | 107 | 136 |
| Weakening | Reference | −22.5% | −37% | −8% |

These results clearly show that the reduction in fatigue strength caused by the method according to an embodiment of the invention is far less than that generated by the conventional anodizing processes, whether standard sulfuric anodizing (OAS) or chromic anodizing (OAC), for an equivalent thickness of the anodic layer. The parts treated by the anodizing method according to an embodiment of the invention notably have better resistance to stresses than those treated by the anodizing processes of the prior art. In particular, in comparison with standard sulfuric anodizing, they allow weight reduction of the structures in which they are used. These parts may moreover be substituted advantageously for the parts treated by chromic anodizing already used, notably in aircraft, without the need for any redimensioning of them.

1.4. Tests of Adherence of Paint Coatings

Parts anodized by the method according to an embodiment of the invention, as indicated above, are submitted to tests of adherence of conventional paint systems.

Two paint systems are tested: a water-dilutable epoxy-based system (P60+F70) and a solvent-treated polyurethane-based system (PAC33+PU66). The tests are carried out according to standard ISO 2409, for dry adherence, after drying of the paint system, and for wet adherence: after drying of the paint system, the samples are immersed in demineralized water for 14 days, then dried before undergoing the adherence test according to the standard.

The results are shown in Table 4 below.

TABLE 4

Results of adherence tests of two paint systems on parts made of rolled aluminum alloy 2024 T3 treated by a method according to an embodiment of the invention

| Paint system | | Dry adherence | Wet adherence |
|---|---|---|---|
| Solvent-treated base | PAC33 | Grade 0 | — |
| | PAC33 + PU66 | Grade 0 | Grade 0 |
| Water-dilutable base | P60 | Grade 0 | — |
| | P60 + F70 | Grade 0 | Grade 0 |

For comparison, similar tests are carried out on parts treated by standard sulfuric anodizing (OAS standard) as indicated above. The results of these tests are given in Table 5 below.

TABLE 5

Results of adherence tests of two paint systems on parts made of rolled aluminum alloy 2024 T3 treated by a standard sulfuric anodizing process

| Paint system | | Dry adherence | Wet adherence |
|---|---|---|---|
| Solvent-treated base | PAC33 | Grade 0 | — |
| | PAC33 + PU66 | Grade 0 | Grade 1 |
| Water-dilutable base | P60 | Grade 1 | — |
| | P60 + F70 | Grade 1 | Grade 2 |

These results show that the parts treated by the method according to an embodiment of the invention display adherence to the paint systems, whether they are of the water-dilutable or solvent-treated type, equivalent to those treated by the conventional anodizing processes OAST and OASB, which, as is known, also give results expressed as Grade 0 in the aforementioned adherence tests. This adherence, for either of the two paint systems, is far higher than that obtained by the standard sulfuric anodizing process proposed in the prior art.

1.5. Corrosion Resistance after Sealing

The parts treated by the method according to an embodiment of the invention, by OAC, OAST or OASB, as indicated above, are submitted to the sealing process C1 according to an embodiment of the invention, as follows:

immersion in an aqueous bath of composition: $CrF_3$: 6 g/L and $K_2ZrF_6$: 1 g/L, in water, at a pH of 3.5 and a temperature of 40° C., for 15 minutes,
then immersion in water at a pH of 6.5, at a temperature of 98° C., for 40 minutes.

As comparative examples, anodized parts are also submitted to the following different conventional methods of sealing: hydrothermal sealing, hot sealing with hexavalent chromium salts, hot sealing with nickel salts, according to the operating conditions shown in Table 6 below.

TABLE 6 operating parameters employed for different methods of sealing

| | Hydrothermal sealing | Sealing with chromium(VI) salts | Sealing with nickel salts |
|---|---|---|---|
| Composition | $H_2O$ | $K_2Cr_2O_7$: 30 mg/L | $(CH_3COO)_2Ni$: 10 g/L |
| Ph | 6.5 | 6 | 5.5 |
| Temperature (° C.) | 98 | 98 | 98 |
| Duration of immersion (min.) | 40 | 20 | 30 |

A sealed anodic layer is obtained on each treated part.

The parts thus treated are submitted to a salt spray test according to standard ISO 9227.

Preliminary approximate average results, obtained on a small number of parts, are shown in Table 7 below.

TABLE 7

Salt spray durability of parts made of rolled aluminum alloy 2024 T3 treated by anodizing and then sealing, anodizing being carried out by a method according to an embodiment of the invention or by anodizing processes of the prior art

| | Salt spray durability (appearance of the 1st corrosion pit) (h) Type of sealing | | | |
|---|---|---|---|---|
| Type of anodizing | Hydrothermal sealing | Sealing with chromium(VI) salts | Sealing with nickel salts | Sealing C1 |
| OAC | 300 | 1500 | — | — |
| OAST | 96 | 1300 | 450 | 550 |
| OASB | 96 | 1000 | 336 | 450 |
| Anodizing according to the invention | 300 | 1500 | 850 | 1600 |

More precise average results relating to appearance of the first corrosion pits (more precisely of the 1st corrosion pit ("1st") and generalized corrosion ("$G^{on}$")), obtained on a larger number of parts, are shown in Table 8 below.

TABLE 8

Salt spray durability of parts made of rolled aluminum alloy 2024 T3 treated by anodizing and then sealing, anodizing being carried out by a method according to an embodiment of the invention or by anodizing processes of the prior art

| | Salt spray durability (h) Type of sealing | | | | | | | |
|---|---|---|---|---|---|---|---|---|
| Type of | Hydro-thermal sealing | | Sealing with chromium(VI) salts | | Sealing with nickel salts | | Sealing C1 | |
| anodizing | 1st | $G^{on}$ | 1st | $G^{on}$ | 1st | $G^{on}$ | 1st | $G^{on}$ |
| OAC | 336 | 1056 | 1320 | 2136 | — | — | — | — |
| OAST | 72 | 192 | 1176 | 1368 | 336 | 840 | 480 | 1344 |
| OASB | 48 | 168 | 912 | 1056 | 288 | 744 | 384 | 1128 |
| Anodizing according to the invention | 312 | 1008 | 1296 | 2064 | 792 | 1344 | 1488 | 2520 |

These results clearly demonstrate that the anodizing process according to an embodiment of the invention, followed by a sealing step, of whatever type, makes it possible to endow the treated part with corrosion resistance at least equivalent to that obtained by the conventional anodizing processes followed by the same sealing.

In particular, the anodizing process according to an embodiment of the invention displays anticorrosion performance equivalent to chromic anodizing (OAC) combined with hydrothermal sealing or hot sealing with hexavalent chromium salts, and far superior to diluted sulfo-tartaric anodizing (OAST) or sulfo-boric anodizing (OASB).

This capacity of the anodic layer formed by the method according to the invention to be sealed in a post-treatment to give it corrosion resistance properties might notably be explained by its morphology with pores larger than 10 nm, which facilitates its hydration during hydrothermal sealing for example, leading to blocking of the pores and protection against corrosion by a barrier layer effect.

Finally it is observed that the particular combination of the anodizing process according to an embodiment of the invention, with the sealing process C1 according to an embodiment of the invention, makes it possible to obtain results in terms of corrosion resistance of the treated part that are far superior to those obtained for any other anodizing/sealing combination.

Example 2

Various parameters of the anodizing process according to the invention are varied relative to the preceding Example 1.

2.1. Variants of Concentration of Sulfuric Acid

Aluminum alloy parts similar to those of Example 1, having previously been submitted to steps of surface preparation as indicated in Example 1 above, are submitted to an anodizing process according to the invention by immersion in a bath at 19° C. containing sulfuric acid at a concentration of 150 or 250 g/l, excluding any other compound. A DC voltage is then applied to each part according to the following voltage profile: voltage increase, from an initial value of 0 V, at a rate of 6 V/min, up to a so-called plateau value of 16 V. The voltage is maintained at the plateau value for 16 minutes.

The anodic layer is then sealed by immersing the part in a water bath at a temperature between 98 and 100° C., for 40 min.

An anodic layer of aluminum oxide/hydroxide with a thickness of about 3.5 to 4.5 μm forms on the surface of each part.

As a comparative example, the same method of treatment by anodizing and then sealing is applied to a similar part, but using a concentration of sulfuric acid in the bath of only 100 g/l.

The parts thus treated are submitted to a salt spray test according to standard ISO 9227. The results obtained are shown in Table 9 below.

TABLE 9

Salt spray durability of parts made of rolled aluminum alloy 2024 T3 treated by anodizing and then sealing, for different sulfuric acid concentrations of the anodizing bath

| Concentration of sulfuric acid in the anodizing bath (g/l) | Salt spray durability (h) | |
|---|---|---|
| | Appearance of the 1st corrosion pit | Generalized corrosion |
| 100 | 120 | 288 |
| 150 | 264 | 888 |
| 250 | 264 | 864 |

These results show the effectiveness, in terms of corrosion resistance of the treated parts, of the anodizing processes according to the invention using a concentration of sulfuric acid in the bath between 150 and 250 g/l. This effectiveness is notably far better than the comparative method using a concentration of sulfuric acid of 100 g/l, which is lower than that recommended by the present invention.

2.2. Variants of the Rate of Voltage Increase

Aluminum alloy parts similar to those of Example 1, having been submitted beforehand to steps of surface preparation as indicated in Example 1 above, are submitted to an anodizing process according to the invention by immersion in a bath at 19° C. containing sulfuric acid at a concentration of 200 g/l, excluding any other compound. A DC voltage is then applied to each part according to the following voltage profile: voltage increase, from an initial value of 0 V, up to a so-called plateau value of 16 V. The voltage is then maintained at the plateau value for 16 minutes. Different rates of voltage increase are tested: 1 V/min, 20 V/min, 32 V/min.

The anodic layer is then sealed by immersing the part in a water bath at a temperature between 98 and 100° C., for 40 min.

An anodic layer of aluminum oxide/hydroxide with a thickness of about 4 to 4.5 μm forms on the surface of each part.

The parts thus treated are submitted to a salt spray test according to standard ISO 9227. The results obtained are shown in Table 10 below.

TABLE 10

Salt spray durability of parts made of rolled aluminum alloy 2024 T3 treated by anodizing and then sealing, for different rates of voltage increase

| Rate of voltage increase (V/min) | Salt spray durability (h) | |
|---|---|---|
| | Appearance of the 1st corrosion pit | Generalized corrosion |
| 1 | 312 | 984 |
| 20 | 288 | 960 |
| 32 | 288 | 984 |

These results show the effectiveness, in terms of corrosion resistance of the treated parts, of the anodizing processes according to the invention using a rate of voltage increase between 1 and 32 V/min.

2.3. Variants of Plateau Voltage Value

Aluminum alloy parts similar to those of Example 1, having been submitted beforehand to steps of surface preparation as indicated in Example 1 above, are submitted to an anodizing process according to the invention by immersion in a bath at 19° C. containing sulfuric acid at a concentration of 200 g/l, excluding any other compound. A DC voltage is then applied to each part according to the following voltage profile: voltage increase, from an initial value of 0 V, at a rate of 3 V/min, up to a so-called plateau value of 14 V or 16 V. The voltage is then maintained at the plateau value for 16 minutes.

The anodic layer is then sealed by the sealing process C1 described in Example 1 above.

An anodic layer of aluminum oxide/hydroxide with a thickness of about 4 to 5 μm forms on the surface of each part.

The parts thus treated are submitted to a salt spray test according to standard ISO 9227. The results obtained are shown in Table 11 below.

TABLE 11

Salt spray durability of parts made of rolled aluminum alloy 2024 T3 treated by anodizing and then sealing, for different voltage plateau values

| Plateau voltage value (V) | Salt spray durability (h) | |
|---|---|---|
| | Appearance of the 1st corrosion pit | Generalized corrosion |
| 14 | 1176 | 2376 |
| 16 | 1320 | 2544 |

These results show the effectiveness, in terms of corrosion resistance of the treated parts, of the anodizing processes according to the invention, finally maintaining the voltage at a plateau value between 14 or 16 V.

2.4. Variants of Anodizing Bath Temperature

Aluminum alloy parts similar to those of Example 1, having been submitted beforehand to steps of surface preparation as indicated in Example 1 above, are submitted to an anodizing process according to the invention by immersion in a bath containing sulfuric acid at a concentration of 200 g/l, excluding any other compound. Several bath temperatures are tested, more particularly 6° C., 12° C. and 25° C.

A DC voltage is then applied to each part according to the following voltage profile: voltage increase, from an initial value of 0 V, at a rate of 3 V/min, up to a so-called plateau value of 16 V. The voltage is maintained at the plateau value for a time of between 10 and 60 minutes, depending on the value of bath temperature. This duration is fixed to obtain an anodic layer of aluminum oxide/hydroxide with a thickness of about 4 to 5 μm on the surface of each part.

The anodic layer is then sealed by the sealing process C1 described in Example 1 above.

As a comparative example, the same method of treatment by anodizing and then sealing is applied to a similar part, but using an anodizing bath temperature of 30° C.

The parts thus treated are submitted to a salt spray test according to standard ISO 9227. The results obtained are shown in Table 12 below.

TABLE 12

Salt spray durability of parts made of rolled aluminum alloy 2024 T3 treated by anodizing and then sealing, for different temperatures of the anodizing bath

| Temperature of anodizing bath (° C.) | Salt spray durability (h) | |
|---|---|---|
| | Appearance of the 1st corrosion pit | Generalized corrosion |
| 6 | 1272 | 2304 |
| 12 | 1224 | 2280 |
| 25 | 1320 | 2424 |
| 30 | 624 | 1536 |

These results show the effectiveness, in terms of corrosion resistance of the treated parts, of the anodizing processes according to the invention using an anodizing bath temperature between 5 and 25° C. This effectiveness is notably far better than the comparative method using a bath temperature of 30° C., which is higher than that recommended by the present invention.

The above description clearly illustrates that, owing to its various features and the advantages thereof, the present invention achieves the stated objectives. In particular, it provides a method for anodizing aluminum alloy parts which avoids the use of substances based on hexavalent chromium, while giving performance, in terms notably of corrosion resistance of the treated part, reduction in fatigue strength and adherence of the paint coatings on the surface of the part, which are at least equivalent to those of the chromic acid anodizing processes, and better than those of the sulfuric anodizing processes proposed in the prior art.

The invention claimed is:

1. A method for anodizing an aluminum or aluminum-alloy part, comprising the step of:

immersing the part in an aqueous bath essentially comprising sulfuric acid at a concentration between 150 and 250 g/L essentially devoid of phosphoric, boric, chromic and tartaric acid, and at a temperature between 5 and 25° C.;

applying a DC voltage to the part immersed in the bath according to a voltage profile comprising an increase in voltage at a rate between 1 and 6 V/min; and maintaining the voltage at a plateau voltage value between 12 and 20 V for a sufficient time to obtain an anodic layer on the surface of the part with a thickness between 3 and 5 μm.

2. The method as claimed in claim 1, further comprising step of maintaining the voltage at the plateau value for a time between 5 and 30 minutes.

3. The method as claimed in claim 1, further comprising step of increasing the voltage at the rate substantially equal to 3 V/min.

4. The method as claimed in claim 1, wherein the plateau voltage value is between 14 and 16 V.

5. The method as claimed in claim 1, wherein the concentration of the sulfuric acid in the bath is between 180 and 220 g/L.

6. The method as claimed in claim 1, wherein the concentration of the sulfuric acid in the bath is substantially equal to 200 g/L.

7. The method as claimed in claim 1, wherein the temperature of the bath is between 15° and 25° C.

8. The method as claimed in claim 1, wherein the temperature of the bath is between 18° and 20° C.

9. The method as claimed in claim 1, further comprising step of degreasing the part prior to immersing the part in the bath.

10. The method as claimed in claim 9, further comprising step of pickling the part prior to immersing the part in the bath.

11. The method as claimed in claim 1, further comprising step of pickling the part prior to immersing the part in the bath.

12. The method as claimed in claim 1, further comprising step of applying the voltage profile until the plateau voltage value is reached.

13. A method of treating surface of a part made of aluminum or aluminum-alloy by submitting the part to an anodizing method as claimed in claim 1 and further comprising a step of sealing the anodic layer formed on the part.

14. The method as claimed in claim 13, further comprising the step of immersing the part in water at a temperature between 98 and 100° C.

15. The method as claimed in claim 13, further comprising the step of immersing the part in an aqueous bath containing a trivalent chromium salt and an oxidizing compound.

16. The method as claimed in claim 15, wherein a temperature of the aqueous bath containing the trivalent chromium salt and the oxidizing compound is between 20 and 80° C.

17. The method as claimed in claim 15, wherein a temperature of the aqueous bath containing the trivalent chromium salt and the oxidizing compound is between 20 and 60° C.

18. The method as claimed in claim 15, further comprising the steps of immersing the part successively in the aqueous bath containing the trivalent chromium salt and the oxidizing compound and subsequently immersing the part in water at a temperature between 98 and 100° C.

* * * * *